US008751225B2

(12) United States Patent
Lee et al.

(10) Patent No.: US 8,751,225 B2
(45) Date of Patent: Jun. 10, 2014

(54) APPARATUS AND METHOD FOR CODING SIGNAL IN A COMMUNICATION SYSTEM

(75) Inventors: Mi-Suk Lee, Daejeon (KR); Hong-Kook Kim, Gwangju (KR); Young-Han Lee, Gwangju (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 601 days.

(21) Appl. No.: 13/106,649

(22) Filed: May 12, 2011

(65) Prior Publication Data

US 2011/0280337 A1 Nov. 17, 2011

(30) Foreign Application Priority Data

May 12, 2010 (KR) ..... 10-2010-0044591
Sep. 16, 2010 (KR) ..... 10-2010-0091025

(51) Int. Cl.
*G10L 19/00* (2013.01)

(52) U.S. Cl.
USPC ..... 704/230; 704/504; 704/224

(58) Field of Classification Search
USPC ..... 704/230, 203, 205–209, 224–225, 704/500–504
See application file for complete search history.

(56) References Cited

U.S. PATENT DOCUMENTS

| | | | | |
|---|---|---|---|---|
| 6,680,972 | B1 | 1/2004 | Liljeryd et al. | |
| 8,438,012 | B2 * | 5/2013 | Kim et al. | 704/203 |
| 8,554,549 | B2 * | 10/2013 | Oshikiri et al. | 704/223 |
| 2008/0140393 | A1 | 6/2008 | Kim et al. | |

FOREIGN PATENT DOCUMENTS

| | | | |
|---|---|---|---|
| KR | 10-0765747 | | 10/2007 |
| KR | 10-0848324 | | 7/2008 |
| KR | 10-2009-0087920 | | 8/2009 |
| WO | 2008/072670 | A1 | 6/2008 |

OTHER PUBLICATIONS

Ebu-Uer, "Sound Quality Assessment Material recordings for subjective tests, Users' handbook for the EBU SQAM CD," EBU-TECH 3253 (2008).
Friedrich, Tobias et al., "Spectral Band Replication Tool for Very Low Delay Audio Coding Applications," 2007 IEEE Workshop on Applications of Signal Processing to Audio and Acoustics, pp. 199-202 (2007).
International Telecommunications Union, "Erratum 1 (May 2003) to ITU-T Recommendation G.722 (Nov. 1988), 7kHz audio-coding within 64 kbit/s," (2003).

(Continued)

*Primary Examiner* — Huyen X. Vo
(74) *Attorney, Agent, or Firm* — Nelson Mullins Riley & Scarborough LLP

(57) ABSTRACT

Provided is an apparatus and method for encoding a voice and audio signal by expanding a modified discrete cosine transform (MDCT) based CODEC to a wideband and a super-wideband in a communication system. The apparatus for encoding a signal in a communication system, includes a converter configured to convert a time domain signal corresponding to a service to be provided to users to a frequency domain signal, a quantization and normalization unit configured to calculate and quantize gain of each subband in the converted frequency domain signal and normalize a frequency coefficient of the each subband, a search unit configured to search patch information of each subband in the converted frequency domain signal using the normalized frequency coefficient, and a packetizer configured to packetize the quantized gain and the searched patch information and encode gain information of each subband in the frequency domain signal.

16 Claims, 2 Drawing Sheets

(56) References Cited

OTHER PUBLICATIONS

International Telecommunications Union, "Processing Test Plan for the ITU-T Joint (G.718/G.729.1) SWB/Stereo extension Optimisation/Characterizations phase," Study Group 16, TD 59 (WP 3/16), (2009).

International Telecommunications Union, "Report of Q23/16 Rapporteur's meeting (Geneva, 8-129 Oct. 2007)," Study Group 16, TD 294R1 (WP 3/16), (2008).

Tammi, Mikko et al., "Scalable Superwideband Extension for Wideband Coding," IEEE International Conference on Acoustics, Speech and Signal Processing, ICASSP 2009, pp. 161-164 (2009).

Lee, Young Han et al., "Super-Wideband Bandwidth Extension Using Normalized MDCT Coefficients for Scalable Speech and Audio Coding," IEEE Signal Processing Letters, (2010).

* cited by examiner

APPARATUS AND METHOD FOR CODING SIGNAL IN A COMMUNICATION SYSTEM

CROSS-REFERENCES TO RELATED APPLICATIONS

The present application claims priority of Korean Patent Application Nos. 10-2010-0044591 and 10-2010-0091025, filed on May 12, 2010, and Sep. 16, 2010, respectively, which are incorporated herein by reference in their entirety.

BACKGROUND OF THE INVENTION

1. Field of the Invention

Exemplary embodiments of the present invention relate to a communication system; and, more particularly, to an apparatus and method for encoding a voice and audio signal by expanding a modified discrete cosine transform (MDCT) based CODEC to a wideband and a super-wideband in a communication system.

2. Description of Related Art

There have many studies actively made to provide services with various Quality of Services (QoS) at a high transmit rate in a communication system. Further, many methods have been introduced to transmit data at a high transmit rate with various QoSs through limited resources in such a communication system. Due to the advance of network technology and the increment of user demand for high quality services, methods for providing a high quality service through a wideband and a super wideband from a narrowband have been introduced.

Furthermore, a bandwidth for transmitting voice and audio in a network has been increased due to the development of a communication technology. It causes the increment of user demands for high quality services through highband voice and audio such as a music streaming service. In order to satisfy such a user demand, a method for compressing and transmitting a high quality voice and audio signal has been introduced.

Meanwhile, various methods for encoding corresponding data to provide various QoS services to users through a wideband and a super wideband have been introduced in a communication system. Particularly, various encoding types of CODECs have been introduced to stably process and transmit data in a high transmit rate. An encoder for encoding data using such CODEC performs an encoding process by a layer, and each layer is separated by a frequency band.

The encoder performs an encoding operation per each band signal of each layer. For example, when the encoder encodes a voice and audio signal, the encoder independently encodes a lowband signal and a highband signal. Particularly, in order to effectively compress and transmit high quality voice and audio signals for providing a high quality voice and audio service to a user, the encoder divides a wideband signal and a super wideband signals into multiples subband signals and independently encodes the multiple subband signals.

The independently coded highband signal has a bit rate similar to that of a lowband signal. After receiving the independently coded highband signal, a receiver restores a lowband signal first and restores a highband signal using the restored lowband signal. The restored lowband signal and the restored highband signal are restored through gain compensation based on an original signal. For the gain compensation in the receiver, the transmitter encodes gain information of the lowband signal and the highband signal and transmits the encoded gain information to the receiver. The receiver performs the gain compensation operation using the encoded gain information transmitted from the transmitter when the encoded lowband and highband signals are restored. Therefore, the encoder of the transmitter independently encodes a voice and audio signal by each band of each layer, encodes the gain information of the voice and audio signal at a bandwidth extension (BWE) layer, and transmit the encoded voice and audio signal with the encoded gain information to the receiver.

However, there is a problem in restoration of the encoded voice and audio signal using the gain information encoded at the BWE layer when the encoder divides a wideband and a super wideband to multiple subbands and independently performs the encoding operation for providing the high quality voice and audio service. In other words, there is a problem in gain compensation of a restored highband signal using gain information encoded at a BWE layer after the receiver restores the highband signal using a restored lowband signal. When the receiver restores the highband signal using the restored lowband signal and uses the gain information encoded at the BWE layer for gain compensation of the restored highband signal, a gain-compensated signal has an error because the encoded gain information does not indicate a real gain of each band, particularly, a real gain of a highband. Such an error causes deteriorating audio quality.

That is, such a gain mismatch problem is generated at a band boundary of the divided subbands by performing the gain compensation operation per each divided subband using the encoded gain information when the gain compensation operation is performed for restoring the encode signal. The gain mismatch problem deteriorates the audio quality.

Therefore, there has been a demand for developing a method for encoding a voice and audio signal by expanding a related CODEC to a wideband and a super wideband in order to provide a high quality voice and audio signal through a wideband and a super wideband in a communication system.

SUMMARY OF THE INVENTION

An embodiment of the present invention is directed to an apparatus and method for encoding a signal in a communication system.

Another embodiment of the present invention is directed to an apparatus and method for encoding a signal by extending a signal to a wideband and a super wideband in a communication system.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with an embodiment of the present invention, an apparatus for encoding a signal in a communication system, includes: a converter configured to convert a time domain signal corresponding to a service to be provided to users to a frequency domain signal; a quantization and normalization unit configured to calculate and quantize gain of each subband in the converted frequency domain signal and normalize a frequency coefficient of the each subband; a search unit configured to search patch information of each subband in the converted frequency domain signal using the normalized frequency coefficient; and a packetizer configured to packetize the quantized gain and the searched patch information and encode gain information of each subband in the frequency domain signal.

In accordance with another embodiment of the present invention, a method for encoding a signal in a communication system, includes: converting a time domain voice and audio signal corresponding to a service to be provided to users to a frequency domain lowband voice and audio signal and a frequency domain highband voice and audio signal; calculating a gain of each subband in the lowband voice and audio signal and the highband voice and audio signal; calculating a quantized gain by quantizing the calculated gain; calculating a normalized frequency coefficient by normalizing a frequency coefficient of the each subband through the quantized gain; calculating patch information of each subband in the lowband voice and audio signal and the highband voice and audio signal using the normalized frequency coefficient; and encoding gain information of each subband in the lowband voice and audio signal and the highband voice and audio signal by packetizing the quantized gain and the patch information.

DESCRIPTION OF SPECIFIC EMBODIMENTS

Figure 1:
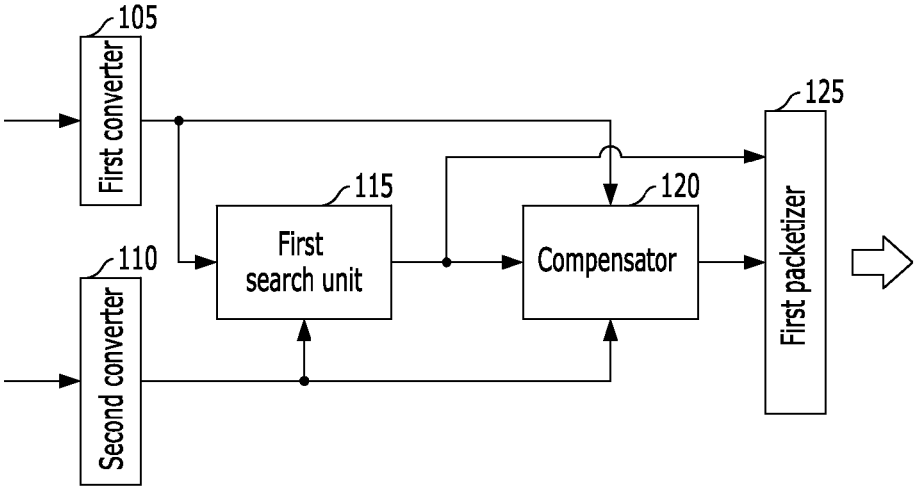
FIG. 1 is a diagram schematically illustrating a structure of an encoder in a communication system in accordance with an embodiment of the present invention.

Exemplary embodiments of the present invention will be described below in more detail with reference to the accompanying drawings. The present invention may, however, be embodied in different forms and should not be constructed as limited to the embodiments set forth herein. Rather, these embodiments are provided so that this disclosure will be thorough and complete, and will fully convey the scope of the present invention to those skilled in the art.

The present invention relate to an apparatus and method for encoding a signal in a communication system. Embodiments of the present invention relates to an apparatus and method for encoding a voice and audio signal by expanding a modified discrete cosine transform (MDCT) based CODEC to a wideband and a super-wideband in a communication system. In other words, in the embodiments of the present invention, a voice and audio signal is encoded by extending a related CODEC to a wideband and a super wideband in order to provide a high quality voice and audio service at a high transmit rate corresponding to a user demand for high quality services with various Quality of Service (QoS) such as a high quality voice and audio service.

In an embodiment of the present invention, a voice and audio signal is encoded through gain compensation after minimizing errors by sharing gain information for gain compensation in all wideband layers and super wideband layers including a lowband and a highband. An encoding apparatus in accordance with an embodiment of the present invention, for example, a scalable encoder, encodes a signal by classifying a base layer and an enhanced layer. Particularly, a wideband and a super wideband are divided into multiplex subband, and a signal is encoded independently by each subband and each layer. The enhanced layer is divided into a lowband enhancement (LBE) layer, a bandwidth extension (BWE) layer, and a highband enhancement (HBE) layer.

When the scalable encoder encodes a voice signal or an audio signal, the scalable encoder additionally encodes a residual signal having amplitude smaller than that of an original signal in order to improve low band voice and audio quality at the LBE layer, and encodes the highband signal independently from the lowband signal. That is, the scalable encoder divides the wideband and the super wideband into multiple subbands and independently encodes a signal by each subband. Such an encoded highband signal has a bit rate similar to the lowband signal.

For example, in case of encoding in the super wideband, the scalable encoder divides a lowband frequency coefficient into four subbands and uses the four subbands as a highband frequency coefficient. The encoded highband signal is restored using a restored lowband signal restored when restoring such an encoded highband signal that is a lowband frequency signal. The encoded highband signal is restored through gain compensation of an original signal. In other words, the scalable decoder divides a wideband and a super wideband into motile subbands and independently performs encoding by each subband in order to effectively compress and transmit a high quality voice and audio signal for providing a high quality voice and audio service to users.

Such an independently encoded highband signal has a bit rate similar to that of a lowband signal. A receiver receiving the encoded signal restores a lowband signal and restores a highband signal using the restored lowband signal. The restored lowband signal and highband signal, particularly, the restored highband signal is restored through gain compensation of an original signal. In order to compensate a gain in signal restoration at a receiver, the scalable encoder encodes gain information of a lowband signal and a highband signal and transmits the encoded gain information to the receiver. The receiver performs gain compensation using the encoded gain information when restoring the lowband signal and the highband signal.

Therefore, the encoder in accordance with an embodiment for the present invention, such as the scalable encoder, independently encodes a voice and audio signal at each layer of wideband and super wideband. Further, the encoder encodes gain information to be shared at each layer of wideband and super wideband for gain compensation in restoring the encoded voice and audio signal. The encoder encodes not only the voice and audio signal but also the gain information for the encoded voice and audio signal by extending a MDCT based CODEC to a wideband and a super wideband.

In other words, the encoder in accordance with an embodiment of the present invention performs encoding by extending a MDCT based voice and audio CODEC to a wideband and a super wideband. The encoder converts a voice and audio signal based on a MDCT scheme for band extension in a frequency domain, obtains a quantized gain as gain information from the MDCT based converted signal, and obtains a patch index as patch information using a normalized frequency coefficient. Accordingly, the encoder shares the gain information at all wideband layers and super wideband layers such as a LBE layer, a BWE layer, and a HBE layer, and improves a service quality with a low bit rate by quantizing a comparative gain ratio between subbands when encoding gain information of each subband. The encoder differently sets up the number of subbands for extracting gain information and the number of subbands for extracting patch information in order to improve a service quality with a low bit rate by dividing the wideband and the super wideband into multiple subbands and independently performing encoding. Accordingly, the gain information is encoded through quantization with a comparative gain ratio between subbands. The gain information is encoded at the BWE layer, and the encoded gain information is shared all wideband layer and super wideband layer.

In an embodiment of the present invention, the patch index is calculated by normalizing a frequency coefficient after a gain parameter is quantized to gain information before calculating a lowband and highband mutual correlation based patch index in the MDCT based converted signal in order to encode a signal by extending a MDCT based voice and audio CODEC to a wideband and a super wideband. The gain information is shored in all wideband layer and super wideband layer, particularly, a HBE layer. The gain information is gain parameters. As described above, the encoder reduces a bit rate by encoding comparative gain bit between divided subbands. Further, the encoder differently sets up the number of subbands for extracting the gain information and the number subbands for extracting patch information. Accordingly, a high quality service is provided with a low bit rate. The encoder extracts the patch information in a minimum mean square error (MMSE) to minimize errors generated during extracting patch information in a subband, and calculates a MMSE based patch index as patch information.

The encoder improves the quality of a high quality service such as voice and audio service by minimizing energy error generation such as gain mismatch between subbands. Further, the encoder extracts gain information of each subband during encoding. That is, the encoder extracts and encodes the substantive gain information of each subband and transmits encoded gain information to a receiver. Accordingly, the encoded gain information is shared when restoring encoded highband signal. The encoder improve voice and audio quality by minimizing errors in gain compensation by reusing quantized gain parameters with a comparative gain ratio at a upper layer such as a HBE layer. Hereinafter, a structure of an encoder in a communication system in accordance with an embodiment of the present invention will be described with reference to FIG. 1.

FIG. 1 is a diagram schematically illustrating a structure of an encoder in a communication system in accordance with an embodiment of the present invention. FIG. 1 schematically illustrates a structure of an encoder for encoding a signal by extending a MDCT based CODEC to a wideband and a super wideband.

Referring to FIG. 1, the encoder includes converters for converting a signal of a related service. Particularly, the encoder includes a first converter 105 and a second converter 110 for converting a voice and audio signal based on a modified discrete cosine transform (MDCT) scheme, a first search unit 115 for searching patch information in each subband of the converted signal from the first and second converters 105 and 110, a compensator 120 for calculating gain information for compensating gain mismatch among subbands of the converted signal using the searched patch information from the first search unit 115, and a first packetizer 125 for packetizing the calculated gain information from the compensator 120 with the searched patch information from the first search unit 115.

The encoder divides a wideband and a super wideband into multiples subbands and independently encodes a signal per each subband and each layer. The wideband and the super wideband are used to transmit a signal to provide a high quality service to users at a high transmit rate. The first search unit 115 and the compensator 120 calculate patch information and gain information from the divided subbands. The high signal independently encoded per each subband and each layer is restored using a restored lowband signal as described above.

The encoder converts a time domain signal to a MDCT based signal in an encoding operation and performs the above described operations. That is, the patch information and the gain information are calculated from each subband by converting a time domain voice and audio signal based on a MDCT scheme and the calculated patch information and gain information are packetized. As described above, the encoder in accordance with an embodiment of the present invention performs a MDCT domain encoding operation and operates in a generic mode and a sinusoidal mode. Particularly, the decoder operates in the generic mode. In the generic mode, the encoder searches a correlation based patch index as patch information from each subband and calculates a gain parameter for compensating gain mismatch as gain information. The sinusoidal mode is a mode for a sine wave signal, for example, a strong periodical voice and audio signal such as an audio signal for musical instruments or a tone signal. In the sinusoidal mode, the encoder extracts information on magnitude of a sine wave signal, a location of frequency coefficient, and coding information of a signal, and packetizes the extracted information. The encoder may independently perform related operations in the sinusoidal mode or simultaneously performs the related operation s of the sinusoidal mode with operation of the generic mode.

The first and second converters 105 and 110 convert a time domain voice and audio signal x(n) to a MDCT domain signal x(k) based on a MDCT scheme. The first converter 105 receives a time domain highband voice and audio signal $x_H(n)$ and converts the received time domain highband voice and audio signal $x_H(n)$ to a MDCT domain voice and audio signal $x_{H,j}(k)$. The second converter 110 receives a time domain lowband voice and audio signal $\hat{x}_L(n)$ and converts the received time domain lowband voice and audio signal $\hat{x}_L(n)$ to a MDCT based voice and audio signal $\hat{x}_L(k)$.

By converting the time domain voice and audio signals $x_H(n)$ and $\hat{x}_L(n)$ based on the MDCT scheme at the converters 105 and 110, the time domain voice and audio signals $x_H(n)$ and $\hat{x}_L(n)$ are converted to frequency domain voice and audio signals. That is, the MDCT domain voice and audio signals $x_{H,j}(k)$ and $\hat{x}_L(n)$ are the frequency domain voice and audio signals.

The time domain voice and audio signals $x_H(n)$ and $\hat{x}_L(n)$ inputting to the converters 105 and 110 are time domain signals encoded for providing a corresponding voice and audio service to users. The time domain voice and audio signals $x_H(n)$ and $\hat{x}_L(n)$ are input to the converters 105 and 110 for encoding gain information. That is, the time domain lowband voice and audio signal $\hat{x}_L(n)$ is a voice and audio signal that the encoder encodes at a basic layer. The time domain lowband voice and audio signal $\hat{x}_L(n)$ is input to the second converter 110 for encoding the gain information in order to share the gain information at the wideband and the super wideband. Further, the time domain highband voice and audio signal $x_H(n)$ is a voice and audio signal that the encoder encodes at an enhanced layer. The time domain highband voice and audio signal $x_H(n)$ is input to the first converter 105 for encoding the gain information to share the gain information at the wideband and the super wideband.

The MDCT domain voice and audio signals $x_{H,j}(k)$ and $\hat{x}_L(n)$ denote voice and audio MDCT coefficients at each subband for encoding gain information. For example, $x_{H,j}(k)$ denotes a MDCT domain voice and audio signal of a $j^{th}$ subband. That is, it is a $k^{th}$ highband MDCT coefficient corresponding to a frequency domain highband voice and audio signal. The highband MDCT coefficient means a highband MDCT coefficient at a corresponding subband in the time domain highband voice and audio signal $x_H(n)$ according to the conversion of the time domain highband voice and audio signal $x_H(n)$ based on the MDCT scheme. $\hat{x}_L(k)$ denotes a MDCT domain voice and audio signal corresponding to a $j^{th}$ subband. That is, it is a $k^{th}$ lowband MDCT coefficient corresponding to a $j^{th}$ subband at a frequency domain lowband voice and audio signal because the highband voice and audio signal is provided using the lowband voice and audio signal. The lowband MDCT coefficient means a lowband MDCT coefficient corresponding to a subband in a time domain lowband voice and audio signal $\hat{x}_L(n)$ according to the conversion of the time domain lowband voice and audio signal $\hat{x}_L(n)$ based on the MDCT scheme.

The first search unit 115 searches patch information at each subband of MDCT domain voice and audio signals $x_{H,j}(k)$ and $\hat{x}_L(n)$ The first search unit 115 searches a correlation-based fetch index from each subband of the converted voice and audio signal $x_{H,j}(k)$ and $\hat{x}_L(n)$. The first search unit 115 searches a patch index from each sub band of a highband signal using a lowband signal. Particularly, a highband frequency coefficient is searched from a lowband frequency coefficient.

In more detail, the first search unit 115 searches a frequency coefficient corresponding to each subband of the converted lowband voice and audio signal $\hat{x}_L(k)$. That is, the first search unit 115 searches a highband frequency coefficient corresponding to a $j^{th}$ subband of the converted highband $x_{H,j}(k)$ from the low frequency coefficient. Then, the first search unit 115 calculates a correlation coefficient between the converted lowband voice and audio signal $\hat{x}_L(k)$ and the converted highband voice and audio signal $x_{H,j}(k)$ at each subband using the searched lowband MDCT coefficient and the searched highband MDCT coefficient. Equation 1 shows the correlation coefficient between the converted lowband voice and audio signal $\hat{x}_L(k)$ and the converted highband voice and audio signal $x_{H,j}(k)$ at each subband can be expressed as below.

$$C(d_j) = \frac{\left|\sum_{k=0}^{N_j-1} X_{H,j}(k)\hat{X}_L(d_j+k)\right|}{\sqrt{\sum_{k=0}^{N_j-1} \hat{X}_L^2(d_j+k)}} \quad \text{Eq. 1}$$

In Equation. 1, $N_j$ denotes a MDCT coefficient at a $j^{th}$ subband. $X_{H,j}(k)$ denotes a $k^{th}$ highband MDCT coefficient corresponding to a $j^{th}$ subband from the converted highband voice and audio signal. $\hat{X}_L(n)$ denotes a $k^{th}$ lowband MDCT coefficient at the converted lowband voice and audio signal. $C(d_j)$ means a correlation coefficient in a $j^{th}$ subband. $d_j$ denotes a correlation coefficient index in a $j^{th}$ subband.

The first search unit 115 calculates the maximum correlation coefficient index $d_j^*$ from the calculated correlation coefficient indexes $d_j$. Equation. 2 shows the maximum correlation coefficient index $d_j^*$ as below.

$$d_j^* = \arg\max_{B_j^{lo} \le d_j \le B_j^{hi}} C(d_j) \quad \text{Eq. 2}$$

In Equation 2, $d_j^*$ denotes the maximum correlation coefficient index among the correlation coefficient indexes calculated through Equation. 1. j is a value in a range of 0, 1, . . . , and (M−1), where M denotes the total number of subbands where the patch information is extracted from. That is, M denotes the total number of subbands where the correlation coefficients $C(d_j)$ are calculated among the divided subbands of the converted voice and audio signals $X_{H,j}(k)$ and $\hat{x}_L(n)$. $B_j^{lo}$ and $B_j^{hi}$ denote boundaries of $j^{th}$ subbands.

The first search unit 115 calculates the correlation coefficients from the divided subbands of the converted voice and audio signals $x_{H,j}(k)$ and $\hat{x}_L(n)$, calculates the maximum correlation coefficient index $d_j^*$ from the calculated correlation coefficients, transmits the calculated maximum correlation coefficient index $d_j^*$ to the compensator 120 and the packetizer 120.

The compensator 120 calculates a gain parameter as gain information for compensating gain mismatch when compensating the gain of the converted voice and audio signals $x_{H,j}(k)$ and $\hat{x}_L(n)$. Particularly, the compensator 120 calculates a gain parameter for compensating a gain mismatch between the converted highband voice and audio signal $X_{H,j}(k)$ and the converted lowband voice and audio signal $\hat{X}_L(k)$. The gain parameter is calculated based on the maximum correlation coefficient index $d_j^*$. That is, the compensator 120 calculates a gain parameter for energy mismatch between a $k^{th}$ high MDCT coefficient and a $k^{th}$ lowband MDCT coefficient. Here, the $k^{th}$ high MDCT coefficient is corresponding to a $j^{th}$ subband in the converted highband voice and audio signal $X_{H,j}(k)$, and the $k^{th}$ lowband MDCT coefficient is corresponding to a jth subband in consideration of the maximum correlation coefficient index $d_j^*$ with the $k^{th}$ lowband MDCT coefficient corresponding to a $j^{th}$ subband in the converted lowband voice and audio signal $\hat{X}_L(n)$.

In other words, the compensator 120 calculates a gain parameter between a MDCT coefficient of the converted highband voice and audio signal $X_{H,j}(k)$ and a MDCT coefficient of the converted lowband voice and audio signal $\hat{X}_L(d_j^*+k)$ with the maximum coefficient index $d_j^*$ considered. The compensator 120 calculates a linear scaling factor $\alpha_{1,j}$ from a linear spectral domain and a log scaling factor $\alpha_{1,2}$ from a log spectral domain as the gain parameter. Equation. 3 shows the linear scaling factor $\alpha_{1,j}$ and Equation. 4 shows the log scaling factor $\alpha_{12}$ as follows.

$$\alpha_{1,j} = \frac{\sum_{k=0}^{N_j-1} X_{H,j}(k)\hat{X}_L(d_j^*+k)}{\sum_{k=0}^{N_j-1} \hat{X}_L^2(d_j+k)} \quad \text{Eq. 3}$$

$$\alpha_{2,j} = \frac{\sum_{k=0}^{N_j-1} (M_j(k)-M_j)D_j(k)}{\sum_{k=0}^{N_j-1} (M_j(k)-M_j)^2} \quad \text{Eq. 4}$$

In Equations 3 and 4, $\alpha_{1,j}$ denotes a linear scaling factor in a $j^{th}$ subband, and $\alpha_{1,2}$ denotes a log scaling factor in a $j^{th}$ subband. $M_j(k)$ Is $\log_{10}|\alpha_{1,j}\hat{X}_L(d_j^*+k)|$. $M_j$ is $\arg\max_k M_j(k)$. $D_j(k)$ is $\log_{10}|X_{H,j}(k)|-M_j$.

As described above, the compensator 120 calculates the linear scaling factor $\alpha_{1,j}$ and the log scaling factor $\alpha_{2,j}$, as the gain parameter for compensating gain mismatch in gain compensation of the converted voice and audio signals $x_{H,j}(k)$ and $\hat{x}_L(n)$ in consideration of the maximum correlation coefficient index $d_j^*$. Then, the compensator 120 calculates gain information for compensating gain between the converted voice and audio signals $x_{H,j}(k)$ and $\hat{x}_L(n)$ through such calculated scaling factors $\alpha_{1,j}$, and $\alpha_{2,j}$, and transmits the linear scaling factor $\alpha_{1,j}$, and the log scaling factor $\alpha_{2,j}$ to the first packetizer 125 as the gain compensated and quantized gain parameters.

The first packetizer 125 receives the maximum correlation coefficient index $d_j^*$ and the linear and log scaling factors $\alpha_{1,j}$ and $\alpha_{2,j}$ as the gain information, and packetizes the received information. That is, the first packetizer 125 packetizes the gain information of the voice and audio signals $X_{H,j}(k)$ and $\hat{x}_L(n)$ from the converters 105 and 110 and outputs the packetized information. The packetized gain information is coded gain information in a BWE in order to be shared in all widebands and super widebands, particularly, a HBE layer. The encoded gain information is transmitted to the receiver.

In the encoder as described above, the converters 105 and 110 convert the time domain voice and audio signal $x_{H,j}(k)$ and $\hat{x}_L(n)$ to the frequency domain voice and audio signals $X_{H,j}(k)$ and $\hat{x}_L(k)$ based on the MDCT scheme. The first search unit 115 searches the MDCT coefficient as a frequency coefficient corresponding to each subband in the frequency domain voice and audio signals $X_{H,j}(k)$ and $\hat{x}_L(k)$, calculates the correlation coefficient $C(d_j)$ between the frequency domain voice and audio signals $X_{H,j}(k)$ and $\hat{x}_L(k)$ using the searched MDCT coefficient, and calculates the maximum correlation coefficient index $d_j^*$ from the calculated correlation coefficients $C(d_j)$. That is, the first search unit 115 searches a MDCT coefficient as a frequency coefficient, calculates the mutual correlation coefficient and the maximum correlation coefficient indication based on the searched MDCT coefficient, and outputs the maximum correlation coefficient as a patch index which is the patch information. The encoder calculates a gain parameter in consideration of the maximum correlation coefficient index which is the patch index. The gain parameter is compensation information for compensating gain mismatch between the frequency domain voice and audio signals $X_{H,j}(k)$ and $\hat{x}_L(k)$. That is, the encoder calculates the linear and log scaling factors $\alpha_{1,j}$ and $\alpha_{2j}$. The first packetizer 125 encodes the gain information and transmits the encoded gain information to the receiver. Hereinafter, an encoder in accordance with another embodiment of the present invention will be described with reference to FIG. 2.

Figure 2:
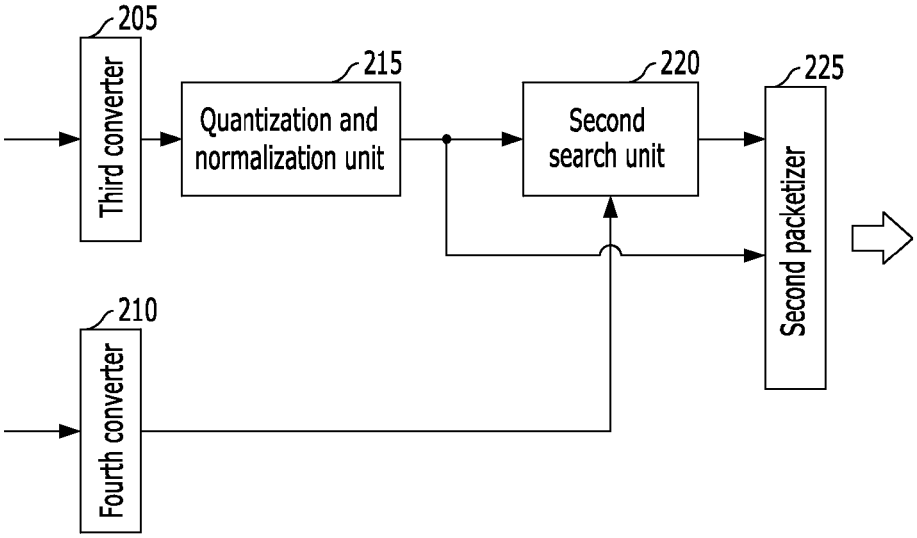
FIG. 2 is a diagram schematically illustrating an encoder in a communication system in accordance with an embodiment of the present invention.

FIG. 2 is a diagram schematically illustrating an encoder in a communication system in accordance with an embodiment of the present invention. That is, FIG. 2 schematically illustrating a structure of an encoder encoding a signal by extending a MDCT based CODEC to a wideband and a super wideband.

Referring to FIG. 2, the encoder includes converters for converting a signal of a related service. Particularly, the encoder includes a third converter 205 and a fourth converter 210 for converting a voice and an audio signal based on a modified discrete cosine transform (MDCT) scheme, a quantization and normalization unit 215 for quantizing a real gain as gain information and normalizing a frequency coefficient, that is, a MDCT coefficient in each subband of the converted signal from the first and second converters 205 and 210, a second search unit 220 for searching patch information in each subband of the MDCT based converted signals using the quantized MDCT coefficient from the quantization and normalization unit 215, and a second packetizer 225 for packetizing the quantized gain information from the quantization and normalization unit 215 and the search information from the second search unit 220.

The encoder divides a wideband and a super wideband into multiples subbands and independently encodes a signal per each subband and each layer. The wideband and the super wideband are used to transmit a signal to provide a high quality service to users at a high transmit rate. The quantization and normalization unit 215 and the second search unit 220 calculate gain information and patch information from the divided subbands. The high signal independently encoded per each subband and each layer is restored using a restored lowband signal as described above.

The encoder converts a time domain signal to a MDCT based signal in an encoding operation and performs the above described operations. That is, the patch information is calculated after calculating the gain information from each subband by converting a time domain voice and audio signal based on a MDCT scheme, and the calculated gain information and patch information are packetized. As described above, the encoder in accordance with another embodiment of the present invention performs a MDCT domain encoding operation and operates in a generic mode and a sinusoidal mode. Particularly, the decoder operates in the generic mode. In the generic mode, the encoder calculates gain information by quantizing real gain and calculates patch information which is a MMSE based patch index in each subband of a typical voice and audio signal. The input time domain voice and audio signal is encoded through an extended MDCT based CODEC which is extended to a wideband and a super wideband. The encoder encodes the gain information to be shared in all widebands and super widebands when compensating gain of the encoded voice and audio signal.

The converters 205 and 210 convert a time domain voice and audio signal (x(n)) to a MDCT domain signal (x(k)) based on a MDCT scheme. The converter 205 receives a time domain highband voice and audio signal $x_H(n)$ and converts the received time domain highband voice and audio signal $x_H(n)$ to a MDCT domain voice and audio signal $X_{H,j}(k)$. The converter 210 receives a time domain lowband voice and audio signal $\hat{x}_L(n)$ and converts the received time domain lowband voice and audio signal $\hat{x}_L(n)$ to a MDCT based voice and audio signal $\hat{x}_L(k)$.

By converting the time domain voice and audio signals $x_H(n)$ and $\hat{x}_L(n)$ based on the MDCT scheme at the converters 205 and 210, the time domain voice and audio signals $x_H(n)$ and $\hat{x}_L(n)$ are converted to frequency domain voice and audio signals. That is, the MDCT domain voice and audio signal $x_H(n)$ and $\hat{x}_L(n)$ are the frequency domain voice and audio signals.

The voice and audio signals $x_H(n)$ and $\hat{x}_L(n)$ inputting to the converters 205 and 210 are time domain signals encoded through a MDCT based voice and audio CODEC extended to a wideband and a super wideband for providing a corresponding voice and audio service to users. The time domain voice and audio signals $x_H(n)$ and $\hat{x}_L(n)$ are input to the converters 205 and 210 for encoding gain information. That is, the time domain lowband voice and audio signal $\hat{x}_L(n)$ is a voice and audio signal that the encoder encodes through a MDCT based voice and audio CEDEC extended to a wideband and a super wideband at a basic layer. The time domain lowband voice and audio signal $\hat{x}_L(n)$ is input to the second converter 210 for encoding the gain information in order to share the gain information at the wideband and the super wideband. Further, the time domain highband voice and audio signal $x_H(n)$ is a voice and audio signal that the encoder encodes through a MDCT based voice and audio CEDEC extended to a wideband and a super wideband at an enhanced layer. The time domain highband voice and audio signal $x_H(n)$ is input to the first converter 205 for encoding the gain information to share the gain information at the wideband and the super wideband.

The MDCT domain voice and audio signals) $x_{H,j}(k)$ and $\hat{x}_L(n)$ denote voice and audio MDCT coefficients at each subband for encoding gain information. For example, $x_{J,j}(k)$ denotes a MDCT domain voice and audio signal of a $j^{th}$ subband. That is, it is a $k^{th}$ highband MDCT coefficient corresponding to a frequency domain highband voice and audio signal. The highband MDCT coefficient means a highband MDCT coefficient at a $j^{th}$ subband in the time domain highband voice and audio signal $x_H(n)$ according to the conversion of the time domain highband voice and audio signal $x_H(n)$ based on the MDCT scheme. The $\hat{X}_L(k)$ denotes a MDCT domain voice and audio signal corresponding to a $j^{th}$ subband. That is, it is a $k^{th}$ lowband MDCT coefficient corresponding to a $j^{th}$ subband at a frequency domain lowband voice and audio signal because the highband voice and audio signal is provided using the lowband voice and audio signal. The lowband MDCT coefficient means a lowband MDCT coefficient corresponding to a subband in a time domain lowband voice and audio signal $\hat{x}_L(k)$ according to the conversion of the time domain lowband voice and audio signal $\hat{x}_L(k)$ based on the MDCT scheme.

The quantization and normalization unit 215 calculates a gain G(j) at each subband of the converted highband voice and audio signal $x_{H,j}(k)$, which is a real gain at each subband of the converted MDCT domain voice and audio signals $X_{H,j}(k)$ and $\hat{X}_L(k)$ from the converters 205 and 210. Equation 5 shows the gain G(j) at each subband as below.

$$G(j) = \frac{1}{N_{g,j}}\sqrt{\sum_{k=0}^{N_j-1} X_{H,j}(k)} \quad \text{Eq. 5}$$

In Equation 5, G(j) denotes a real gain at each subband of the converted MDCT domain voice and audio signals $X_{H,j}(k)$ and $X_L(k)$. Particularly, G(j) denotes a real gain in a $j^{th}$ subband of the converted highband voice and audio signal $x_{H,j}(k)$. j is in a range of 0 to $M_g-1$, $M_g$ denotes the total number of subbands where the gain information is extracted from. That is, $M_g$ denotes the total number of subbands for calculating the real gain G(j) in the divided subbands of the converted voice and audio signal $X_{H,j}(k)$ and $\hat{X}_L(k)$. In Equation 5, $N_{g,j}$ denotes the number of MDCT coefficients corresponding to a gain of a $j^{th}$ subband. $X_{H,j}(k)$ denotes a $k^{th}$ highband MDCT coefficient corresponding to a $j^{th}$ subband in the converted highband voice and audio signal $x_{H,j}(k)$. That is, the quantization and normalization unit 215 calculates a frequency coefficient of each subband of the converted MDCT domain voice and audio signals $X_{H,j}(k)$ and $\hat{X}_L(k)$. Particularly, the quantization and normalization unit 215 calculates the real gain G(j) using the MDCT coefficient.

After calculating the real gain G(j) at each subband of the converted voice and audio signals $X_{H,j}$ and $\hat{X}_L(k)$, particularly, calculating a gain G(j) at each subband of the converted highband voice and audio signal $X_{H,j}(k)$, the quantization and normalization unit 215 quantizes the calculated gain of each subband. The quantization and nomalization unit 215 quantizes the gain G(j) at each subband with a gain rate. That is, the quantization and nomalization unit 215 quantizes the gain G(j) with a comparative gain rate between adjacent subbands. In other words, the gain G(j) is quantized at each subband based on gain rate information. Since the comparative gain rate between adjacent subbands is smaller than a real calculated gain which is a dynamic range of a gain G(j) in each subband as shown in Equation 5, it may reduce an overload in gain information encoding in the encoder and gain information processing in a receiver.

The quantization and normalization unit 215 quantizes the real gain G(j) in each subband of the converted voice and audio signals $X_{H,j}(k)$ and $\hat{X}_L(k)$. Equation 6 shows the quantized gain G(j) as blow.

$$\hat{G}(j) = \begin{cases} Q_m(G(j)), \\ Q_n\left(\frac{G(j)}{\hat{G}(j-1)}\right) \cdot \hat{G}(j-1) \end{cases} \quad \text{Eq. 6}$$

In Equation 6, $\hat{G}(j)$ denotes a quantized gain of a real gain G(j) in each subband. $Q_m(G(j))$ denotes the quantized gain $\hat{G}(j)$ when j is 0. $Q_n(x)$ denotes x's n-bit scalar quantization.

$$Q_n\left(\frac{G(j)}{\hat{G}(j-1)}\right) \cdot \hat{G}(j-1)$$

denotes the quantized gain $\hat{G}(j)$ when $j=0, \ldots, M_g-1$.

The quantization and normalization unit 215 normalizes a frequency coefficient of each subband of the converted voice and audio signals $X_{H,j}(k)$ and $\hat{X}_L(k)$ using the quantized gain $\hat{G}(j)$ of each subband. That is, the quantization and normalization unit 215 normalizes the MDCT coefficient. The normalized MDCT coefficient may be expressed as Equation 7.

$$X_{H,j}(k) = \frac{X_{H,j}(k)}{\hat{G}(j)} \quad \text{Eq. 7}$$

In Equation 7, $\hat{X}_{H,j}(k)$ denotes a $k^{th}$ quantized highband MDCT coefficient corresponding to a $j^{th}$ subband, which is a real gain of each subband of the converted voice and audio signals $X_{H,j}(k)$ and $\hat{X}_L(k)$, and particularly is a MDCT coefficient normalized in each subband of the converted highband voice and audio signal $X_{H,j}(k)$.

As described above, the quantization and normalization 215 calculates a gain G(j) at each subband of the converted frequency domain voice and audio signals $X_{H,j}(k)$ and $\hat{X}_L(k)$, quantizes the calculated gain G(j), transmits the MDCT coefficients $\hat{X}_{H,j}(k)$ normalized through the quantized gain $\hat{G}(j)$ to the second search unit 220, and transmits the quantized gain $\hat{G}(j)$ as gain information to the second packetizer 225. That is, the quantization and normalization unit 215 calculates the quantized gain $\hat{G}(j)$ and the normalized MDCT coefficient $\hat{X}_{H,j}(k)$ at each subband of the converted frequency domain voice and audio signals $X_{H,j}(k)$ and $\hat{X}_L(k)$ by performing gain quantization/normalization.

The second search unit 220 searches and calculates a MMSE based patch index in each subband of the converted frequency domain voice and audio signals $X_{H,j}(k)$ and $\hat{X}_L(k)$ as patch information using the normalized MDCT coefficient $\hat{X}_{H,j}(k)$ from the quantization and normalization unit 215. In more detail, the second search unit 220 calculates a patch index $d_l^*$ as patch information from each subband of the converted voice and audio signals $X_{H,j}(k)$ and $\hat{X}_L(k)$ such as the converted highband voice and audio signal $X_{H,j}(k)$. The patch index $d_l^*$ is calculated based on the MMSE scheme. Equation 8 shows the patch index $d_l^*$ below.

$$d_j^* = \arg\max_{B_j^{lo} \le d_j \le B_j^{hi}} E(d_j) \quad \text{Eq. 8}$$

In Equation 8, $E(d_j)$ can be expressed as below Eq. 9.

$$E(d_j) = \sum_{k=0}^{J_{f,l}-1} \left(\hat{X}_H(k) - \hat{X}_L(d_l + k)\right)^2 \quad \text{Eq. 9}$$

In Equations 8 and 9, $d_l^*$ is a patch index in each subband of the converted voice and audio signals $X_{H,j}(k)$ and $\hat{X}_L(k)$ such as the converted highband voice and audio signal $X_{H,j}(k)$. That is, $d_l^*$ denotes a patch index of a $1^{st}$ subband. $d_l$ means a corresponding coefficient index in a $1^{st}$ subband. $d_l^*$ means a minimum average value of $E(d_l)$ according to MMSE based calculation. That is, $d_l^*$ denotes a minimum average of energy gain errors between the highband voice and audio signal and the lowband voice and audio signal in consideration of the MDCT coefficient normalized in each subband of the converted voice and audio signals $X_{H,j}(k)$ and $\hat{X}_L(k)$. That is, $d_l^*$ denotes a minimum average. In other words, $d_l^*$ denotes the MMSE based patch index. The number of subbands for calculating the normalized MDCT coefficient $\hat{X}_{H,j}(k)$ is setup differently from the number of subbands for calculating the MMSE based patch index $d_l^*$ in the second search unit 220.

In Equations 8 and 9, $E(d_j)$ denotes an energy gain error between the lowband voice and audio signal and the highband voice and audio signal considered with a MDCT coefficient normalized at each subband of the converted voice and audio signals $X_{H,j}(k)$ and $\hat{X}_L(k)$ denotes a normalized NDCT coefficient of the converted highband voice and audio signal $X_{H,j}(k)$. $\hat{X}_L(d_l+k)$ denotes a normalized MDCT coefficient of the lowband voice and audio signal $\hat{X}_L(k)$ considered with correlation. Here, $\hat{X}_L(d_l+k)$ is $$\hat{X}_L(d_j+k) \Big/ \sqrt{\sum_{k=0}^{N_{f,j}-1} X_{LL}^2(d_j+k)}\,.$$

$N_{f,j}$ denotes the total number of MDCT coefficients corresponding to the $1^{st}$ subband, and $B_l^{lo}$ and $B_l^{hi}$ denote boundaries of the $1^{st}$ subband.

The second search unit 220 calculates the patch index $d_l^*$ based on a MMSE scheme in divided subbands of the converted voice and audio signals $X_{H,j}(k)$ and $\hat{X}_L(k)$ using the normalized MDCT coefficient $\hat{X}_{H,j}(k)$ The calculated MMSE based patch index this transmitted to the second packetizer 225 as patch information from each subband of the converted voice and audio signals $X_{H,j}(k)$ and $\hat{X}_L(k)$.

The second packetizer 225 receives the quantized gain $\hat{G}(j)$ from the quantized unit 215 and the MMSE based patch index $d_l^*$ from the second search unit 220 and packetizes the received information. That is, the second packetizer 225 packetizes gain information for the time domain voice and audio signals $x_H(n)$ and $\hat{x}_L(n)$ inputting to the converters 205 and 210, encodes the gain information of each subband of the converted voice and audio signals $X_{H,j}(k)$ and $\hat{X}_L(k)$, and outputs the encoded gain information. The packetized gain information is transmitted to a receiver as gain information encoded at a BWE layer to be shared at all widebands and super widebands, particularly, in a HBE layer. The encoded gain information is shared al all wideband and super wideband when compensating a gain for the MDCT based converted frequency domain voice and audio signal.

As described above, the converters 205,210 convert the time domain voice and audio signal $x_H(n)$ and $\hat{x}_L(n)$ received for encoding gain information to the frequency domain voice and audio signals $X_{H,j}(k)$ and $\hat{X}_L(k)$ based on the MDCT scheme. The quantization and normalization unit 215 calculates a real gain $G(j)$ of each subband of the frequency domain voice and audio signals $X_{H,j}(k)$ and $\hat{X}_L(k)$, calculates a quantized gain $\hat{G}(j)$ by quantizing the calculated gain $G(j)$, and calculates the normalized MDCT coefficient $X_{H,j}(k)$ by normalizing the MDCT coefficient using the quantized gain. That is, after calculating the quantized gain $\hat{G}(j)$ and the normalized MDCT coefficient $\hat{X}_{H,j}(k)$ of each subband of the frequency domain voice and audio signals $X_{H,j}(k)$ and $\hat{X}_L(k)$, the quantization and normalization 215 outputs the quantized gain $\hat{G}(j)$ as gain information from each subband of the frequency domain voice and audio signals $X_{H,j}(k)$ and $\hat{X}_L(k)$.

Further, the second search unit 220 calculates the MMSE based patch index $d_l^*$ as patch information using the normalized MDCT coefficient $\hat{X}_{H,j}(k)$ and outputs the calculated MMSE based patch index $d_l^*$ as patch information. The second packetizer 225 packetizes the quantized gain $\hat{G}(j)$ as gain information and the MMSE based patch index $d_l^*$ as patch information, encodes the gain information for the time domain voice and audio signals $x_H(n)$ and $\hat{x}_L(n)$, and transmits the encoded gain information to the receiver. The encoded gain information is gain information of each sub band of the frequency domain voice and audio signals $X_{H,j}(k)$ and $\hat{X}_L(k)$. The encoded gain information is shared with all wideband and super wideband including a HBE layer. As described above, a service quality is improved as a low bit rate by quantizing a real gain with a comparative gain ratio. Hereinafter, a method for encoding a signal at an encoder in a communication in accordance with an embodiment of the present invention will be described with FIG. 3.

Figure 3:
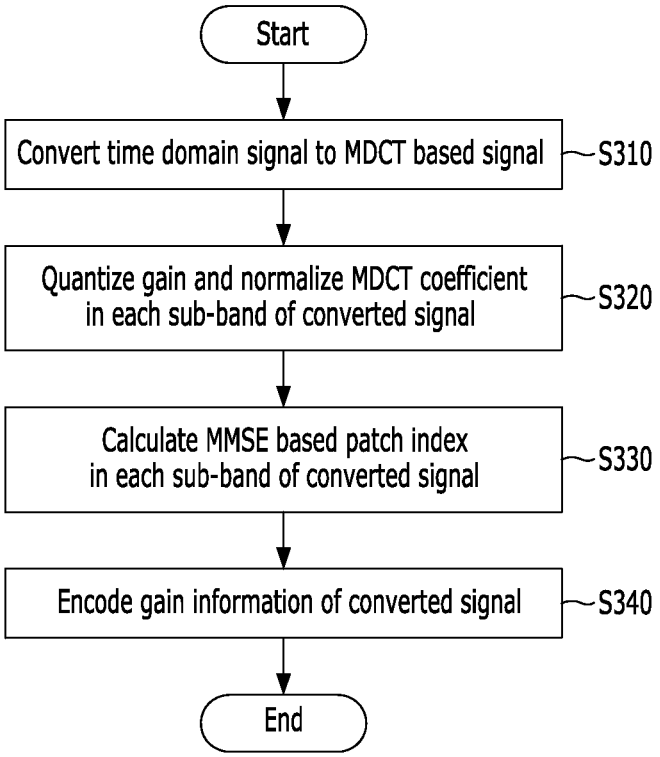
FIG. 3 is a diagram schematically illustrating a method for encoding a signal in a communication system in accordance with an embodiment of the present invention.

FIG. 3 is a diagram schematically illustrating a method for encoding a signal in a communication system in accordance with an embodiment of the present invention.

Referring to FIG. 3, at step S310, the encoder encodes a voice and audio signal of a service to be provided to a user such as a voice and audio service through a MDCT based CODEC which is extended to a wideband and a super wideband from a corresponding layer. In order to share gain information of the encoded voice and audio signal in the wideband and the super wideband when the encoded voice and audio signal is transmitted to a receiver through a wideband and a super wideband, the encoder converts a time domain encoded voice and audio signal based on a MDCT scheme to encode the gain information of the encode voice and audio signal. The MDCT based converted voice and audio signal is converted to a frequency domain signal from a time domain signal. In other words, since the encoded voice and audio signal is transmitted to the receiver through a wideband and super wideband, the time domain encoded voice and audio signal becomes a highband voice and audio signal and a lowband voice and audio signal, and the highband voice and audio signal and the lowband voice and audio signal are converted to a frequency domain signal from a time domain signal by the MDCT based conversion. That is, the encoder converts the time domain encoded voice and audio signal to the frequency domain encode voice and audio signal.

At step S320, the encoder calculates a real gain of each subband in the frequency domain voice and audio signal, calculates a quantized gain by quantizing the calculated gain of each subband in the converted voice and audio signal with a comparative gain ratio, and calculates a normalized MDCT coefficient by normalizing a MDCT coefficient which is a frequency coefficient of each subband in the frequency domain voice and audio signal using the calculated quantized gain. The quantized gain is gain information of each subband in the frequency domain voice and audio signal. Since the calculations of the real gain, the quantized gain, and the normalized MDCT coefficient were already described, the detailed descriptions thereof are omitted.

At step S330, the encoder calculates a patch index as patch information of each subband in the frequency domain voice and audio signal using the normalized MDCT coefficient.

The patch index is calculated based on the MMSE scheme using the normalized MDCT coefficient. That is, the patch index becomes the MMSE based patch index. Since the calculation of the patch index of each subband in the frequency domain voice and audio signal was already described, the detailed description thereof is omitted.

At step S340, the encoder packetizes the calculated quantized gain and the MMSE based patch index, encodes the gain information of each subband of the time domain voice and audio signal, and transmits the encoded gain information to the receiver. The encoded gain information is shared in all wideband and super wideband for the frequency domain voice and audio signal, particularly at a HBE layer, and a high quality voice and audio service is provided at a low bit rate.

In the embodiments of the present invention, a voice and audio signal is encoded by extending a modified discrete cosine transform (MDCT) based CODEC to a super wideband in a communication system. Accordingly, gain information for gain compensation is shared all wideband and super wideband including a lowband and a highband. Further, gain compensation is performed with error minimized by sharing the gain information in all wideband and super wideband. That is, a high quality voice and audio service is provided through gain compensation with error minimized with a low bit rate in a communication system.

While the present invention has been described with respect to the specific embodiments, it will be apparent to those skilled in the art that various changes and modifications may be made without departing from the spirit and scope of the invention as defined in the following claims.

What is claimed is:

1. An apparatus for encoding a signal in a communication system, comprising:

a converter configured to convert a time domain signal to a frequency domain signal wherein the time domain signal is a signal corresponding to a service to be provided to users;

a quantization and normalization unit configured to calculate and quantize gain of each subband in the converted frequency domain signal and normalize a frequency coefficient of the each subband;

a search unit configured to search patch information of each subband in the converted frequency domain signal using the normalized frequency coefficient; and a packetizer configured to packetize the quantized gain and the searched patch information and encode gain information of each subband in the frequency domain signal.

2. The apparatus of claim 1, wherein the converter converts the time domain signal to a frequency domain highband signal and a frequency domain lowband signal based on a modified discrete cosine transform (MDCT) scheme.

3. The apparatus of claim 2, wherein the quantization and normalization unit normalizes the MDCT coefficient of each subband with the frequency coefficient.

4. The apparatus of claim 1, wherein the quantization and normalization unit calculates a gain of the each subband using a frequency coefficient of the each subband and calculates a quantized gain by quantizing the calculated gain with a comparative gain rate between subbands.

5. The apparatus of claim 4, wherein the quantization and normalization unit normalizes a frequency coefficient of each subband in the converted frequency domain signal using the quantized gain.

6. The apparatus of claim 1, wherein the search unit calculates a patch index of each subband based on a minimum mean square error (MMSE) using the normalized frequency coefficient.

7. The apparatus of claim 6, wherein the packetizer encodes the gain information at a bandwidth extension (BWE) layer by packetizing the quantized gain and the patch index.

8. The apparatus of claim 7, wherein the encoded gain information is shared in all wideband and super-wideband for the frequency domain signal when compensating a gain.

9. The apparatus of claim 1, wherein the time domain signal is encoded through a modified discrete cosine transform (MDCT) based voice and audio CODEC extended to a wideband and super wideband.

10. A method for encoding a signal in a communication system, comprising:

converting a time domain voice and audio signal to a frequency domain lowband voice and audio signal and a frequency domain highband voice and audio signal, wherein the time domain voice and audio signal is a signal corresponding to a service to be provided to users;

calculating a gain of each subband in the lowband voice and audio signal and the highband voice and audio signal;

calculating a quantized gain by quantizing the calculated gain;

calculating a normalized frequency coefficient by normalizing a frequency coefficient of the each subband through the quantized gain;

calculating patch information of each subband in the lowband voice and audio signal and the highband voice and audio signal using the normalized frequency coefficient; and encoding gain information of each subband in the lowband voice and audio signal and the highband voice and audio signal by packetizing the quantized gain and the patch information.

11. The method of claim 10, wherein in said converting, the time domain voice and audio signal is converted to the frame domain lowband voice and audio signal and the frame domain highband voice and audio signal based on a modified discrete cosine transform (MDCT).

12. The method of claim 11, wherein the frequency coefficient is a modified discrete cosine transform coefficient of the lowband voice and audio signal and the highband voice and audio signal.

13. The method of claim 10, wherein in said calculating a quantized gain, the quantized gain is calculated by quantizing the calculated gain with a comparative gain ration between subbands in the lowband voice and audio signal and the highband voice and audio signal.

14. The method of claim 10, wherein in said calculating patch information, the patch information is calculated in the each subband based on a minimum mean square error (MMSE) using the normalized frequency coefficient.

15. The method of claim 10, wherein in said encoding, the gain information is encoded in a bandwidth extension (BWE) layer to be shared in all wideband and super wideband for the lowband voice and audio signal and the highband voice and audio signal when compensating a gain.

16. The method of claim 10, wherein the time domain voice and audio signal is encoded through a modified discrete cosine transform (MDCT) based voice and audio CODEC extended to a wideband and a super-wideband.

* * * * *